United States Patent [19]

Koskol et al.

[11] Patent Number: 4,991,261

[45] Date of Patent: Feb. 12, 1991

[54] APPARATUS AND PROCESS FOR PNEUMATIC SEGMENTING OF COMPACTED FIBER WADS FOR CONTINUOUS PACKAGE LAYER FORMATION

[75] Inventors: Joseph E. Koskol; Louis G. Rosanio, Jr., both of Wilmington, Del.

[73] Assignee: E. I. Du Pont de Nemours and Company, Wilmington, Del.

[21] Appl. No.: 324,532

[22] Filed: Mar. 14, 1989

[51] Int. Cl.[5] ..... B65H 61/00

[52] U.S. Cl. ..... 19/1; 28/289

[58] Field of Search ..... 19/1 A; 28/289; 206/392

[56] References Cited

U.S. PATENT DOCUMENTS

| | | | |
|---|---|---|---|
| 710,937 | 10/1902 | Baker . | |
| 2,080,185 | 5/1937 | Rathgeber | 100/31 |
| 3,341,911 | 9/1967 | Smith | 28/1 |
| 3,410,394 | 11/1968 | Jackson et al. | 206/59 |
| 3,478,399 | 11/1969 | Wyatt et al. | 28/21 |
| 3,885,278 | 5/1975 | Whitaker | 28/1.3 |
| 3,898,719 | 8/1975 | Lloyd | 28/1.4 |
| 3,968,877 | 7/1976 | Mattis | 206/388 |
| 4,180,214 | 12/1979 | Li et al. | 242/47 |
| 4,450,607 | 5/1984 | Li et al. | 28/257 |
| 4,863,029 | 9/1989 | Koskol et al. | 206/392 X |
| 4,936,001 | 7/1990 | Koskol et al. | 28/289 |

*Primary Examiner*—Werner H. Schroeder
*Assistant Examiner*—John J. Calvert

[57] ABSTRACT

A layered yarn package is formed of continuous filament yarn wads wherein the yarn alternates between compacted and extended lengths by axially compacting the yarn into a length, segmenting the length into alternating extended and compacted lengths, then arranging the compacted lengths in a common axial direction one next to the other to form a layer. The segmenting is accomplished by jetting pressurized fluid onto the continuous filament yarn wads in a programmed manner.

6 Claims, 5 Drawing Sheets

APPARATUS AND PROCESS FOR PNEUMATIC SEGMENTING OF COMPACTED FIBER WADS FOR CONTINUOUS PACKAGE LAYER FORMATION

BACKGROUND OF THE INVENTION

This invention relates to an apparatus and process for packaging yarn into a layered package from a continuous filament formed into a compact wad and, more particularly, it relates to an apparatus and process for segmenting the wad into distinct segments.

The above-noted application Ser. No. 07/121,059 which is incorporated herein by reference discloses that certain yarns can be processed by forming an axially compact continuous wad of multifilament yarn which can be essentially retained in the wad form when packaged. During the packaging step, particularly for a package that is formed of layers of wads connected to adjacent layers with an extended length pulled from the wads, it is desired to form a structure of an axially compacted length of yarn (wad) connected by an extended length of yarn to another compacted length. The extended length is pulled from the compacted lengths and remains connected to the compacted lengths, the extended and compacted lengths forming a continuous length of yarn.

When using a blade to segment the wad into distinct segments as taught in U.S. Ser. No. 07/121,059, there is a possibility that damage may occur to the strands forming the wad because of the nature of the wad formation which does not enable a clean separation of the wad into segments as will be described in more detail later.

SUMMARY OF THE INVENTION

The present invention provides an improvement in the apparatus and method described in U.S. Ser. No. 07/121,059 by using jets of a pressurized fluid to segment the wad cleanly into distinct segments. More particularly, the invention comprises an apparatus and process for pneumatically segmenting a wad into finite compacted and extended lengths. The apparatus consists of a separating and forwarding portion, a venting and stopping portion and a collecting portion. In operation, a jet of air first forms a separation in the continuously formed compacted wad. Other jets then propel the downstream compacted wad segment away from the upstream continuously forming wad. An extended length of fiber strand pulled from the compacted ends connects the downstream, segmented, compacted wad to the upstream continuously forming compacted wad. The pressurized air between the wads maintains the integrity of the ends of the wads so only a single extended length is pulled off instead of clumps of compacted fibers. The propulsion air is then vented and the motion of the segmented wad is stopped. The compacted segment is then indexed out of the wad path and placed with other wad segments to form a sheet of compacted and extended lengths. An extended length piles up and is pushed ahead of the newly segmented compacted length as it is propelled away from the continuously forming wad. As the newly formed segment passes the adjacent segment in the sheet, the extended length pays out from the pile and ends up between the newly segmented compacted length and the previously segmented compacted length. The process then repeats until a completed sheet of compacted and extended lengths is formed. The sheet is then removed in a manner described in U.S. Ser. No. 07/121,059.

Such a system of pneumatic segmenting can be usefully employed with other types of wads as well and has the advantage of requiring no moving parts (other than commercial valves) to accomplish the segmenting. Other types of wads may be those that separate with squared ends or cupped ends and are composed, for instance, of densely compacted dry fibers, such as small denier Dacron®, or loosely compacted moist fibers, such as bulked continuous filament yarn In the case of moist fibers, heating of the surfaces in contact with the fibers may be required to reduce friction with the moving wads.

DETAILED DESCRIPTION OF THE ILLUSTRATED EMBODIMENTS

Figure 1:
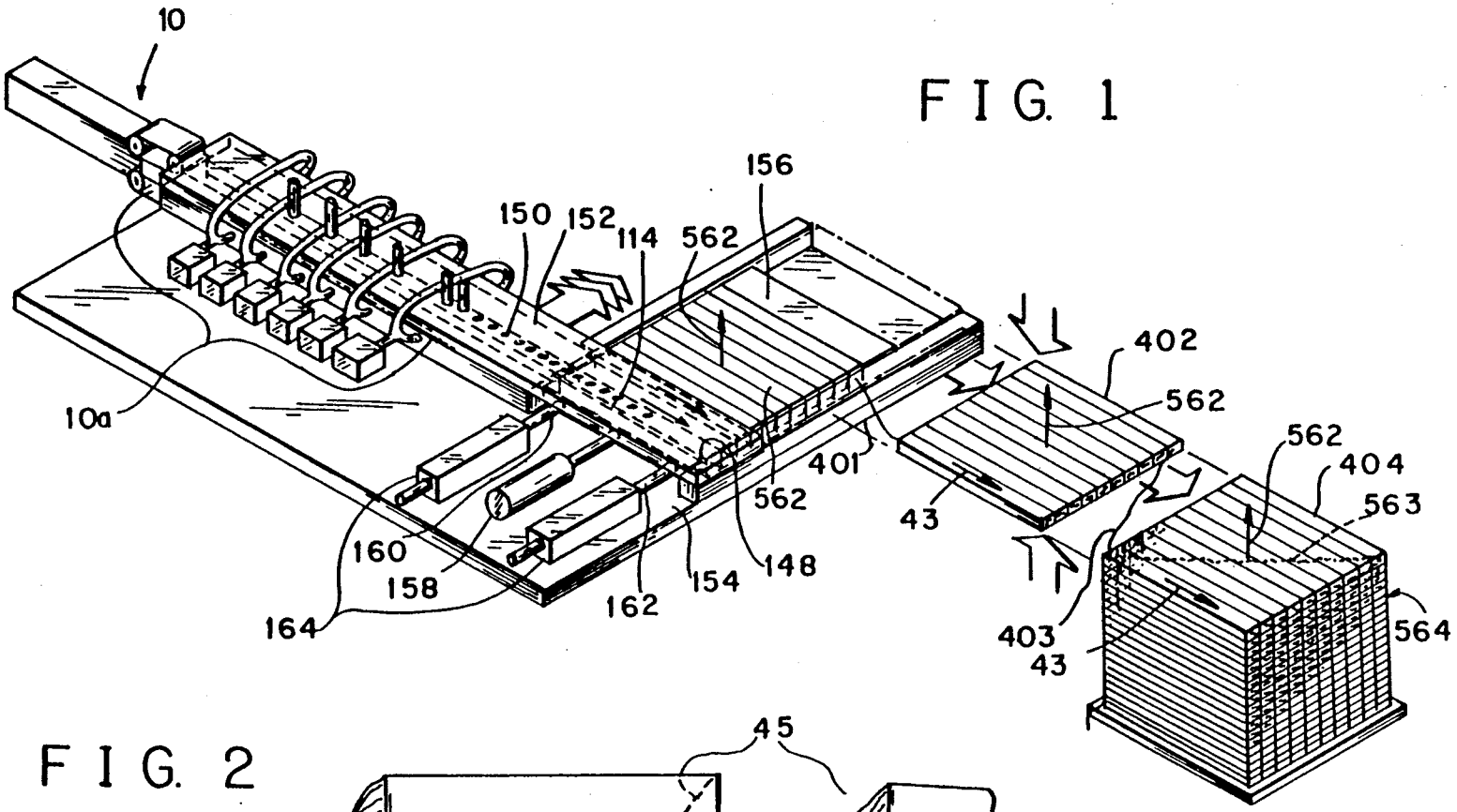
FIG. 1 is a schematic perspective illustration of the segmenting system of this invention combined with the layer formation process described in connection with FIG. 13 of U.S. Ser. No. 07/121,059.

Referring now to FIG. 1, the packaging process of this invention is shown diagrammatically wherein a continuous compacted length of wad from wad former 10 is forwarded first into the separating and forwarding portion 10*a* of the pneumatic system of this invention, then to be collected in the packaging process of the invention in which the continuous wad from wad former 10 is formed into a new layer 562, while a first previously formed layer 402, still connected to the new layer, is placed in a compression press where it is compressed to a higher density. A second previously formed layer 404, still connected to the first previously formed layer, has been removed from the compression station and placed on a layer receiving elevator. By forming individual layers from the wad, the layers can be processed independently, such as by compression, while new layers are being formed. This results in finally processed layers that can be packaged directly in a container suitable for storage or shipping. The process can be readily adapted to produce different size layers and thereby different size packages from the same wad former.

Figure 2:
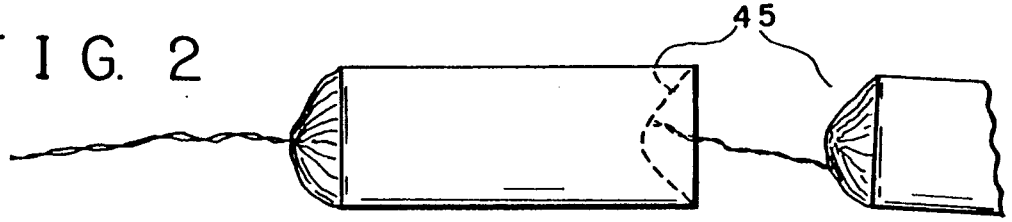
FIG. 2 is a schematic illustration of the shape of the ends of one type of wad that can be separated according to this invention.

As shown in FIG. 2, a problem can exist when separating the wads into compacted length segments and pulling the extended length from the wads in that the wads are difficult to separate cleanly and avoid having small clumps of wad between the compacted segments. This is particularly true when the wad end 45 of the wad is a cupped or irregular shape; that is, the yarn when deposited in the wad varies considerably in longitudinal position in the wad as it is laid down going from the center to the periphery of the wad cross-section. If such a cupped or irregularly shaped wad is segmented by a blade that mechanically shears the wad, such as in the referenced application, there is a possibility that there may be damage to the strands running in the longitudinal direction, or clumps of compacted strands will be pulled from the wad. This problem of cleanly separating a wad into segments can be solved by using jets of pressurized fluid such as air to segment the wad into extended and compacted lengths.

Separating and Forwarding Portion

Figure 3:
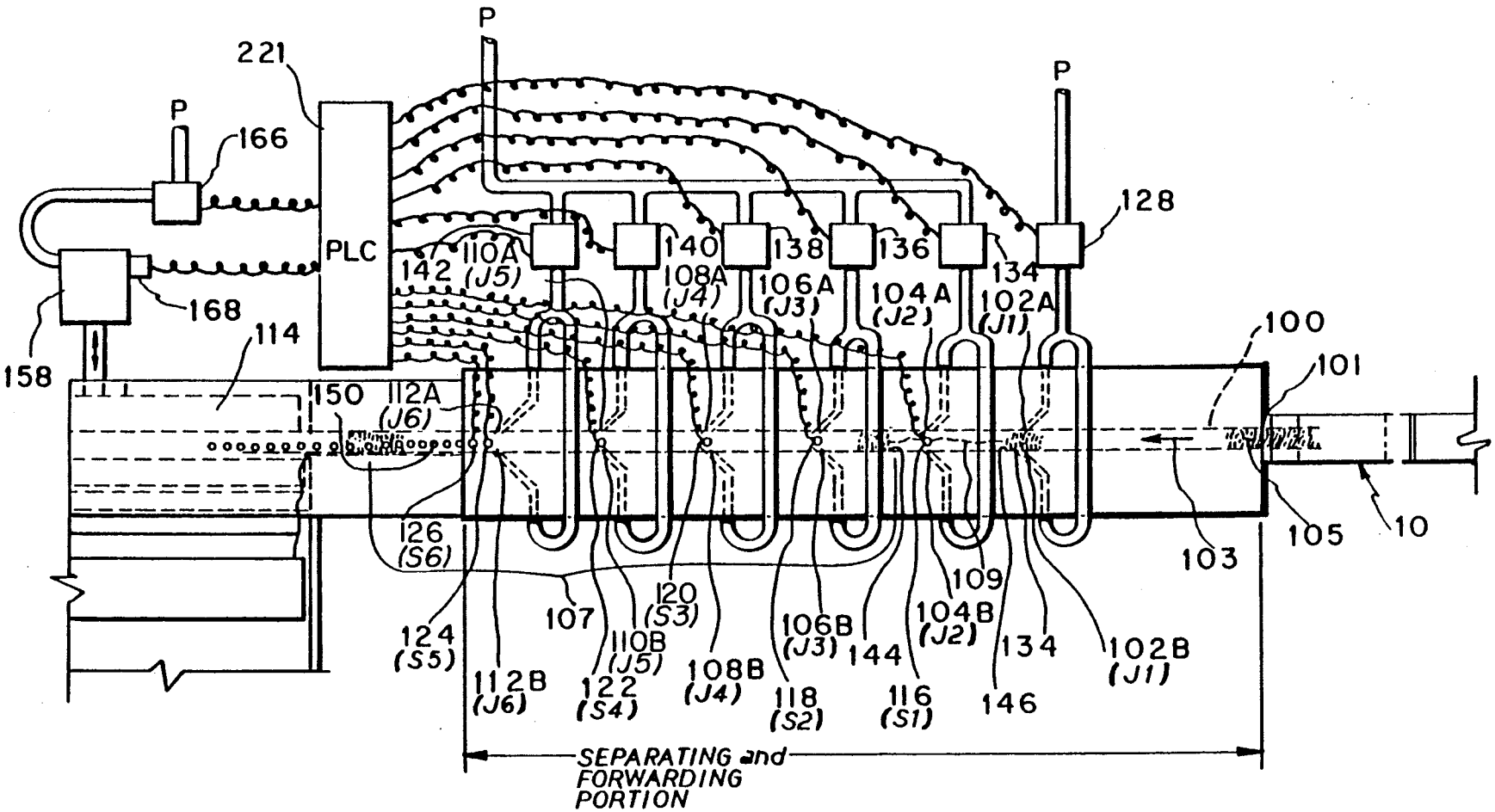
FIG. 3 is a schematic representation of the pneumatic separating and forwarding apparatus of this invention.
Figure 4:
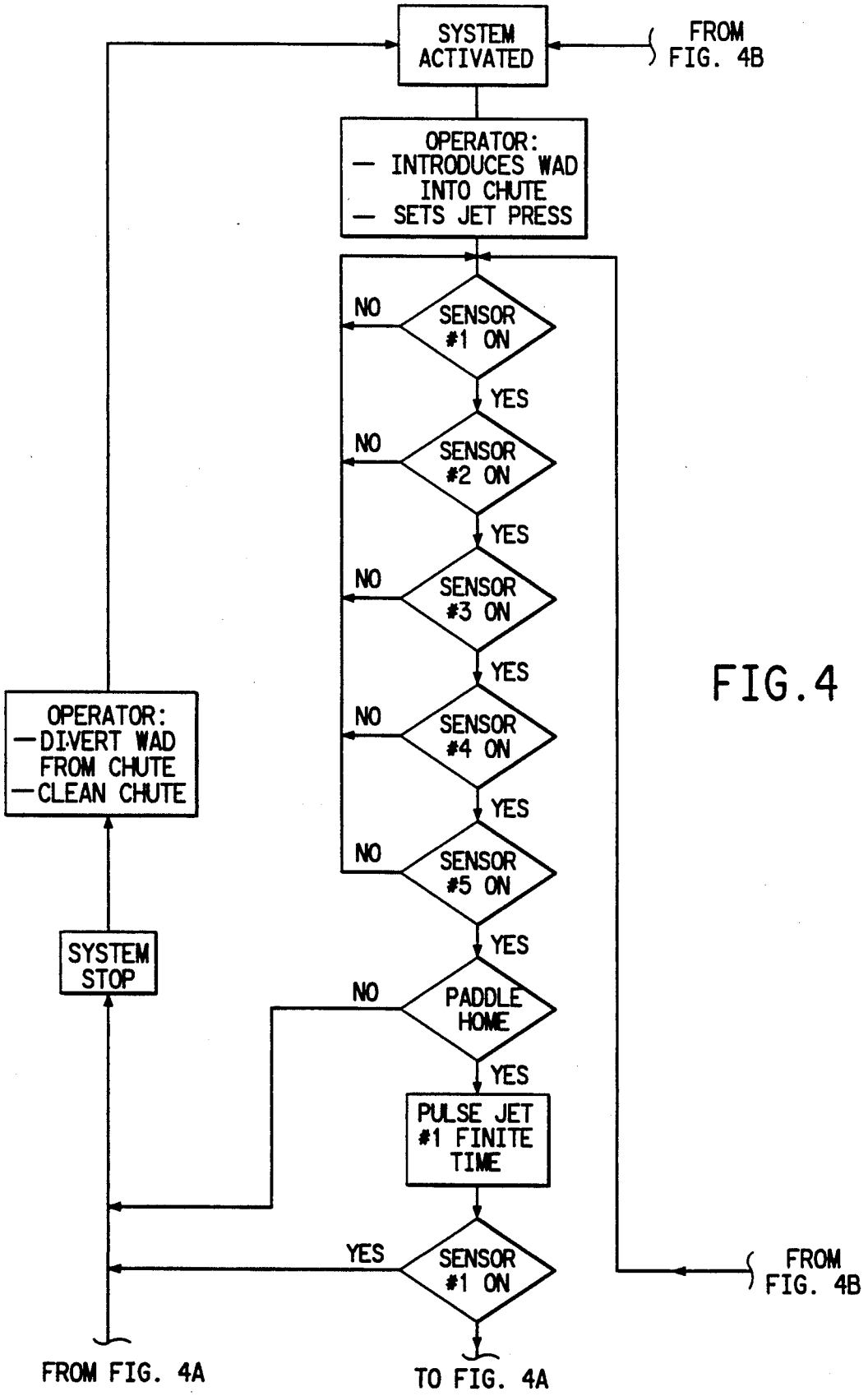
FIGS. 4, 4A and 4B are logic flow diagrams used to sequence the operations for pneumatic segmenting and for detecting malfunctions in the sensor/jet system of the separating portion of the pneumatic system of this invention.
Figure 4A:
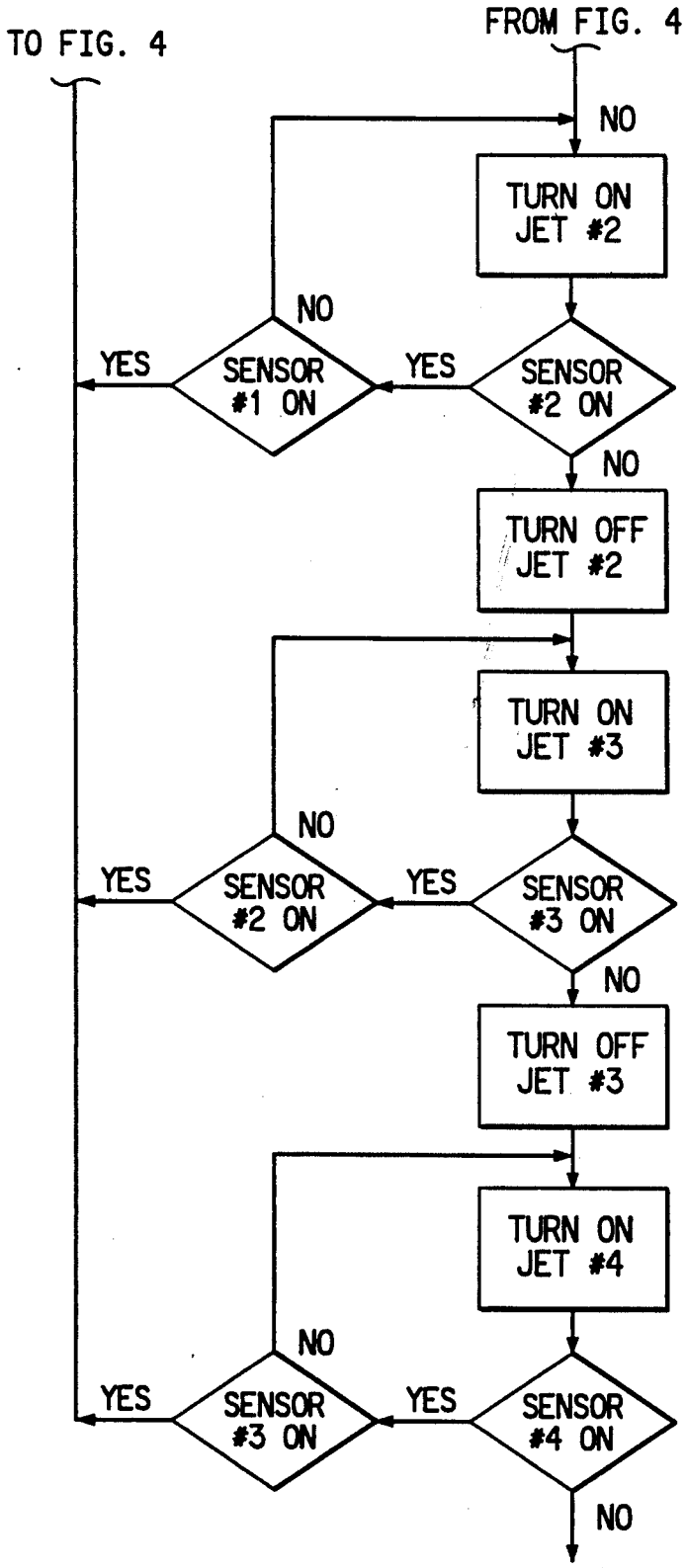
Figure 4B:
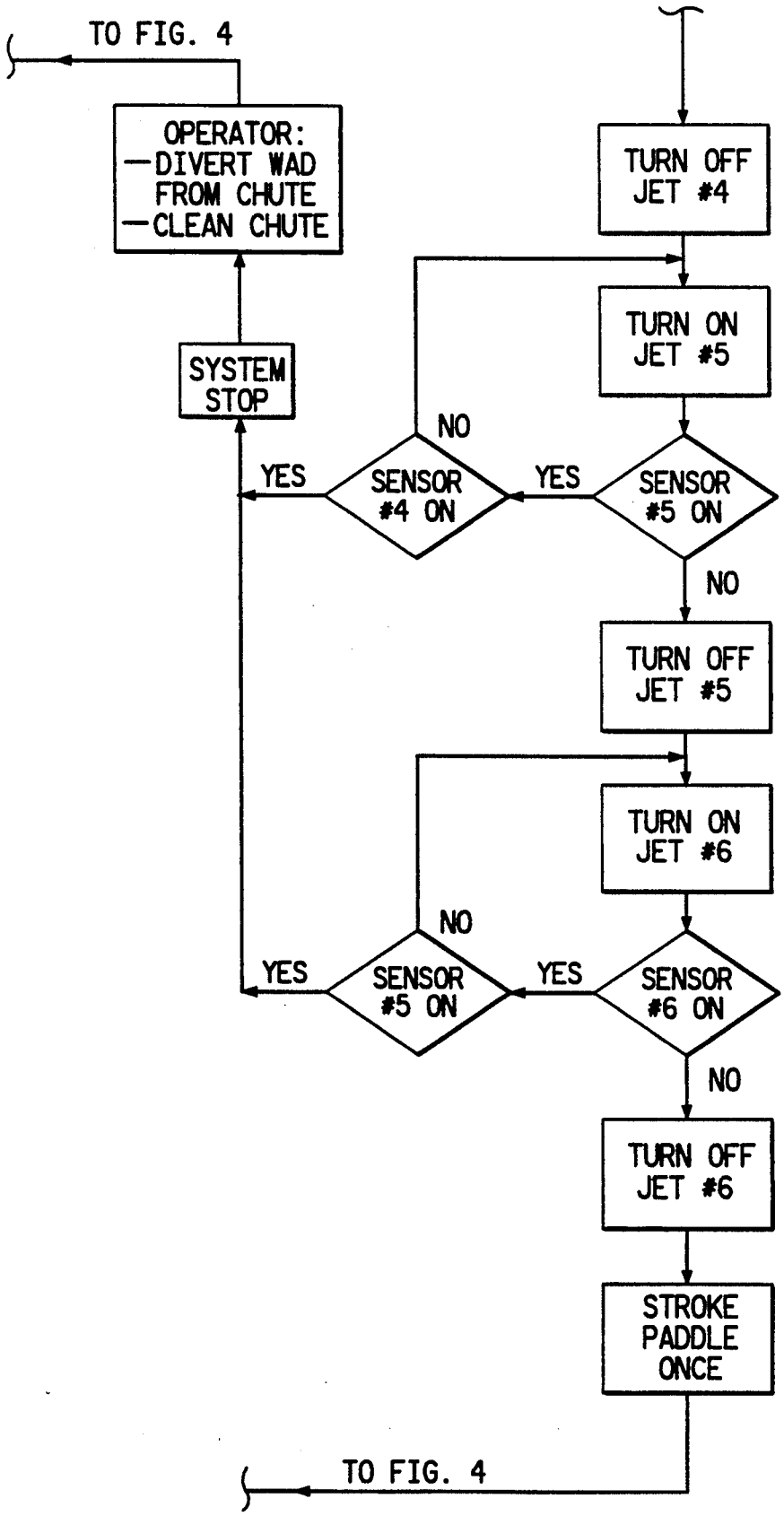

The separating and forwarding portion 10*a* is shown in more detail in FIG. 3. It consists of an elongated, enclosed wad channel 100 which is in fluid communication with air jet orifices 102A and B, 104A and B, 106A and B, 108A and B, 110A and B, and 112A and B. The wad can move freely through the channel which may have anti-friction coatings applied to the surfaces contacting the wad. Optical sensors 116, 118, 120, 122, 124 and 126 are arranged along the channel 100 to detect the presence or absence of the wad at different locations along the channel. In FIG. 3, an instant of time is shown just after the wad 105 has been separated and a segment 107 is being forwarded away from the continuously advancing wad. FIG. 4 shows the logic diagram that explains the sequence of operations for pneumatic segmenting of wads. Referring to FIGS. 3 and 4, the wad 105 enters channel 100 at 101 and is continuously advanced by the wad forming apparatus 10 in the direction of arrow 103.

The operation of the separating and forwarding portion will be explained in more detail referring to FIGS. 3 and 4. Initially the continuously advancing wad moves through the channel 100 until the leading end is detected by sensor 124, S5. The sensor sends an "on" signal to programmable logic controller (PLC) 221. PLC 221 checks that paddle 114 is in the retracted or "home" position by monitoring sensor 168. When these conditions are all present, the PLC actuates two-way valve 128 sending air at pressure P1 to angled orifices 102A and 102B, referred to as jets J1. An angle of about 45 degrees (0.79 radians) has been found to work well. The air jetting through the orifices separates the wad at about the location 134 where the angled jet streams converge. The valve 128 stays "on" for a predetermined time and then closes shutting off the flow of air to orifices 102A and B. This time is selected so that the trailing end of the segmented wad forwarded by the jet will travel just past sensor 116, S1.

Alternatively to timing off the valve, feedback from S1 indicating no wad is present can be used to turn off valve 128 to J1. It is important to turn J1 off before the continuously advancing wad end 146 has advanced beyond orifices 102A and B. FIG. 3 shows the instant of time just after the jets J1 have been turned off and end 146 has advanced beyond orifices 102A and B. For a short time after separating the wad with J1, the end 146 of the continuously advancing wad is held stationary by the pressure from the jet. If the jets J1 remained on too long, they would strip off compacted yarn from the end 146 of the wad as it advances. The length of channel 100 upstream of J1 is sufficient so there is not excess pressure leakage past continuously advancing wad 105. The wad 105 will continue to come into channel 100 at 101 and will be connected to the separated wad segment 107 by extended length 109. When sensor 116, S1 senses that there is no wad present, it sends an "off" signal to PLC 221 which turns on valve 134 which provides air at pressure P2 to orifices 104A and 104B, jets J2. P2 is preferably less than P1 since it does not have to separate the wad but only has to provide a pressure to keep the wad segment 107 moving down channel 100 at a rate faster than the continuously advancing wad 105. For different wad densities and cohesiveness, the time delay for separating the wad and the values of P1 and P2 may have to be adjusted For a yarn of about 4 denier per filament (4.4 decitex) compacted into a wad having a density of about 18 lbs./cubic foot (0.29 g per cc), and for a jet orifice size of about 70 mils (1.8 mm), a P1 of about 20 psi (138 kPa) and a P2 of about 10 psi (69 kPa) should provide good operation.

When the wad segment propelled by pressure P2 has advanced beyond sensor 118, S2, causing an "off" signal, the PLC turns off valve 134 which stops the air flow to jets J2. Simultaneously the PLC turns on valve 136 that supplies air at pressure P2 to orifices 106A and 106B, jets J3. This continues advancing the wad segment at a rate faster than the continuously advancing wad so the extended length 109 pulled from the wad ends is lengthened.

When the end of the wad segment reaches sensor S3 causing an "off" signal, jets J3 are turned off and jets J4 are turned on. This process continues as S4 senses the passage of the wad end and J4 is turned off and J5 is turned on, and S5 is "off" (no wad) resulting in J5 turning off and J6 turning on. The air from J6 causes the wad segment 107 to leave passage 100. This is confirmed by sensor 126, S6, at the end of the passage. This results in the turning off of valve 142 that provides pressure to J6. The wad segment end 144 now has stopped separating from the continuously advancing wad end 146 which is now somewhere further down channel 100. The distance between end 144 and 146 must be at least as long as the length of segment 107 so that extended length 109 can reach from opposite ends of adjacent segments that are arranged in a side by side arrangement as in the referenced patent application.

In FIG. 4 there is also logic that will detect malfunctions in the sensor/jet system of separating the segment. If the preceding sensor, which was off, detects the continuous advancing wad before the succeeding sensor detects the passage of the segmented wad, the system shuts down so the operator can divert the advancing wad and clear the passage.

Venting and Stopping Portion

The wad segment as it leaves the separating and forwarding portion continues moving due to inertia and the pressure on the wad from the last forwarding jet J6 that was used to forward the segment away from the continuously advancing wad. To stop the segment it is important to vent this pressure rapidly before the leading end of the segment impacts the wall of the collecting portion at 148 in FIG. 1. Venting of the pressure is accomplished by a controlled release of air through cover plate orifices 150 in cover plate 152. The orifices should not be so large that the yarn can bend and be forced into the orifice by the exhausting air; orifices of less than about 60 mils were found to work well. Friction primarily between the wad segment and the side of paddle 114 and the top of collecting plate 154 acts to slow the segment so the speed at impact with wall 148 is low enough to not cause wad breakup due to rebound or buckling.

Collecting Portion

The first wad segment enters a closely fitting space defined by the top of plate 154, the bottom of cover 152, the side of paddle 114 and the side of start-up slider bar 156. After the first segment is in the collecting portion, the paddle 114 is stroked forward slightly more than the distance of the width of the segment and is then retracted to its home position. The closely fitting space for the second segment is then defined as above except one side is now the side of the first segment instead of the side of start-up slider bar 156. As additional segments are collected, they are advanced laterally along collecting plate 154 until a layer 562 of segments are available for stacking in a package formation as is described in the '059 application. The start-up slider bar 156 can be removed by the operator after forming the first layer and is no longer required for continued operation since some of the segments always remain, after removing a layer, to form the one side of the closely fitting space.

The paddle is cycled back and forth by linear actuator 158 which may be a single acting air cylinder in fluid communication with three-way valve 166 and pressure source P. Valve 166 is controlled by PLC 221. The paddle is guided by attached guide rods 160 and 162 riding in bushings 164.

What is claimed is:

1. A method of separating and forwarding a segment of compacted fibers from an advancing continuous length of compacted fibers, the segment and continuous length remaining connected by an extended length of fibers, comprising the steps of:

(a) advancing the continuous length through a channel;

(b) sensing when the continuous length's leading edge approaches the exit of the channel;

(c) jetting the continuous length with a pressurized fluid at a position spaced from the exit of the channel to separate a segment of compacted fiber from the continuous length forming separated ends of the segment and continuous length;

(d) stopping the jetting before the separated end of the continuous length advances beyond the jetting position; and (e) sensing the separated end of the segment and applying fluid pressure to the separated end to advance the segment at a rate exceeding the advancing rate of the continuous length to thereby forward the segment away from the continuous length before the separated end of the segment reaches the exit of the channel.

2. A method of separating, forwarding and collecting segments of a compacted fiber wad from an advancing continuous length of compacted fiber wad, comprising the steps of:

(a) advancing said continuous length through a channel toward the exit of the channel;

(b) separating, using jets of pressurized fluid, a segment of compacted fiber wad having a finite length, a distance from the continuous length of fiber wad, and forwarding the segment away from said continuous length, before exiting the channel fluid;

(c) venting the pressurized fluid as the segment leaves the exit of the channel;

(d) stopping the advancing segment;

(e) advancing the segment laterally after the segment leaves the channel; and (f) repeating the steps (a) through (e).

3. The method of claim 2 wherein said distance is approximately the length of the segment.

4. An apparatus for separating and forwarding a segment of compacted fibers from an advancing continuous length of compacted fibers, the segment and continuous length remaining connected by an extended length of fibers, comprising:

(a) means for advancing the continuous length through a channel;

(b) means for sensing when the leading end of the continuous length approaches the exit of the channel;

(c) means for jetting the continuous length with a pressurized fluid at a position spaced from the exit of the channel to separate a segment of compacted fiber from the continuous length to form separated ends of the segment and continuous length;

(d) means for stopping the jetting before the separated end of the continuous length advances beyond the jetting position; and (e) means for sensing the separated end of the segment and applying fluid pressure to the separated end to advance the segment at a rate exceeding the advancing rate of the continuous length to thereby forward the segment away from the continuous length before the separated end of the segment reaches the exit of the channel.

5. An apparatus for separating, forwarding and collecting segments of a compacted fiber wad from an advancing continuous length of compacted fiber wad, comprising:

(a) means for advancing said continuous length through a channel toward the exit of the channel;

(b) jets of pressurized fluid for separating a segment of compacted fiber wad having a finite length, a distance from the continuous length of fiber wad, and forwarding said segment away from said continuous length before exiting the channel;

(c) means for venting the pressurized fluid as said segment leaves the exit of the channel;

(d) means for stopping the advancing segment;

(e) means for advancing the segment laterally after the segment leaves the channel; and (f) means for repeating the steps (a) through (e).

6. The apparatus of claim 5 wherein said distance is about the length of the segment.

* * * * *